United States Patent [19]

Lehmann et al.

[11] Patent Number: 4,869,606

[45] Date of Patent: Sep. 26, 1989

[54] IMAGE RECORDING APPARATUS INCLUDING A RIBBON CARTRIDGE WITH A PLATEN AND PAPER GUIDE

[75] Inventors: Herbert Lehmann; Hans J. Kardinal, both of Berlin, Fed. Rep. of Germany

[73] Assignee: Siemens Aktiengesellschaft, Munich, Fed. Rep. of Germany

[21] Appl. No.: 209,892

[22] Filed: Jun. 22, 1988

[30] Foreign Application Priority Data

Jun. 24, 1987 [DE] Fed. Rep. of Germany ..... 3721231

[51] Int. Cl.[4] ..... B41J 35/28

[52] U.S. Cl. ..... 400/208; 400/120; 400/246; 400/693.1

[58] Field of Search ..... 400/207, 208, 208.1, 400/224.1, 224.2, 240.3, 625, 634, 120, 88, 203, 642, 659, 692, 693.1, 691, 693, 246

[56] References Cited

U.S. PATENT DOCUMENTS 4,702,631 10/1987 Watanabe ..... 400/208

FOREIGN PATENT DOCUMENTS 0208203 1/1987 European Pat. Off. .
0225582 6/1987 European Pat. Off. .
OS 3535767 4/1986 Fed. Rep. of Germany .
OS 3537572 4/1986 Fed. Rep. of Germany .
OS 3539526 5/1986 Fed. Rep. of Germany .
25476 3/1981 Japan ..... 400/692
60-24973 2/1985 Japan .
127181 7/1985 Japan ..... 400/208
22981 1/1986 Japan ..... 400/208
83077 4/1986 Japan ..... 400/208
235172 10/1986 Japan ..... 400/208

*Primary Examiner*—David A. Wiecking
*Attorney, Agent, or Firm*—Hill, Van Santen, Steadman & Simpson

[57] ABSTRACT

An apparatus for recording image information on a recording sheet is provided comprising a line-shaped recording head arranged in a housing of said apparatus, comprising a pressure member lying opposite said recording head, and comprising a ribbon cartridge connectable to said housing that contains a pressure member and an inked ribbon that can be conducted past the recording head in sections transversely relative to the line direction upon interposition of the recording sheet lying against the pressure member, thereby to enable an automatic conveying of the recording sheet. It is further provided that a sheet feeder device and a sheet deposit device are arranged in the housing and that the ribbon cartridge contains a sheet guide device extending between the pressure member and the sheet feeder device on the one hand and the sheet deposit device on the other hand for transferring the recording sheet coming from the sheet feeder device to the pressure member and from the latter to the sheet deposit device. The new apparatus is employed as a printer comprising a line-shaped recording head.

11 Claims, 5 Drawing Sheets

IMAGE RECORDING APPARATUS INCLUDING A RIBBON CARTRIDGE WITH A PLATEN AND PAPER GUIDE

BACKGROUND OF THE INVENTION

The invention is directed to an apparatus for recording image information on a recording sheet, comprising a line-shaped recording head arranged in a housing of the apparatus, comprising a ribbon cartridge connectable to the housing, the ribbon cartridge containing a pressure member and an inked ribbon that can be conducted past the recording head in sections transversely relative to line direction, being conducted past upon interposition of the recording sheet lying against the pressure member.

Such an apparatus disclosed by German published Application No. 35 39 526, which corresponds to U.S. Pat. No. 4,702,631 is fashioned as a thermal transfer printer operating in parallel, whereby a line-shaped recording head is arranged inside a housing. The housing comprises a lateral opening through which a ribbon cartridge is introducible into the housing in the direction along the recording head, this housing containing a pressure member in the form of a printing roller and an inked ribbon on two winding reels parallel to the axis of the printing roller. At its side facing away from the recording head, the ribbon cartridge comprises a window-shaped recess through which a recording sheet to be printed on is manually and individually introducible into the ribbon cartridge, so that the recording sheet, lying against the printing roller, is moved past the recording head by the latter upon interposition of the inked ribbon and can again be conveyed out of the ribbon cartridge through the same recess. The known apparatus enables only a manual feed of individual recording sheets to be printed on.

German Published Application No. 35 37 572 which corresponds to U.S. Pat. No. 4,710,041 discloses an apparatus fashioned as a thermal transfer printer operating in parallel, whereby an automatic feed or, respectively, removal of the recording sheets to be printed is provided within the apparatus. Both a line-shaped recording head as well as a printing roller aligned parallel to the axis thereof are arranged inside the housing of the known apparatus. An inked ribbon having a width corresponding to about the length of the recording head is stored in a ribbon cartridge introducible into the housing, being stored therein on two winding reels parallel to the axis of the printing roller. The inked ribbon section respectively situated between the two winding reels proceeds in part outside a concavely fashioned outside of the ribbon cartridge, so that this outside and the appertaining inked ribbon section form a cavity accessible from the side. Proceeding from the side, i.e. in the direction longitudinal relative to the printing roller or, respectively, to the recording head, the ribbon cartridge can be introduced into a correspondingly fashioned opening in the housing of the known apparatus such that the inked ribbon section proceeding outside the ribbon cartridge ends up between the recording head and the printing roller, whereby the cavity between the concave outside of the ribbon cartridge and the inked ribbon section accepts the recording head. When a ribbon cartridge is being changed, therefore, the line-shaped recording head is held firmly in the housing of the known apparatus at only one end; only after the ribbon cartridge has been replaced is a restraint for the other end of the recording head likewise enabled in that the opening in the housing is closed with a cover that comprises a support for the other end of the recording head.

SUMMARY OF THE INVENTION

It is an object of the present invention to provide an apparatus for recording image information comprising a ribbon cartridge that is extremely simple to replace and comprising an automatic conveying of the recording sheets to be printed inside the apparatus.

This object is inventively achieved in that a sheet feeding means and a sheet deposit means are arranged in the housing; and in that the ribbon cartridge contains a sheet guiding means extending between the pressure member and the sheet feeder means on the one side and the sheet deposit means on the other side for conveying the recording sheet coming from the sheet feeder means to the pressure member and from the latter to the sheet deposit means.

The significant advantage of the apparatus of the invention is that an automatic conveying of the recording sheets to be printed inside the apparatus occurs together with a ribbon cartridge that can be plugged to the housing without further ado and can be in turn detached therefrom, occurring in that every recording sheet to be printed is conveyed out of the housing into the ribbon cartridge secured at the housing, is conducted past the recording head together with the inked ribbon for the purpose of printing and, subsequently, is again returned out of the ribbon cartridge into the housing.

It is conceivable within the framework of the invention that the housing comprises a receptacle opening into which the ribbon cartridge is pluggable, so that openings for transferring the recording sheet between the ribbon cartridge and the housing and for both-sided access of the recording head and of the pressure member relative to one another can be fundamentally arranged in all of those outsides of the ribbon cartridge that, when the ribbon cartridge is mounted at the housing, come to lie inside its receptacle opening. Preferably, however, the housing and the ribbon cartridge have only a single side adjacent against one another. An especially simple structure of the apparatus of the invention is thereby achieved, whereby the appertaining, adjoining sides of the ribbon cartridge and of the housing are preferably aligned perpendicular to the direction in which the ribbon cartridge is plugged onto the housing or, respectively, is detached therefrom.

In this context, the structural outlay for the apparatus of the invention is advantageously limited to a minimum in that the ribbon cartridge and the housing are parts of an overall housing that can be respectively plugged to one another; and in that, with the exception of the sides adjoining one another, all further sides of the housing and of the ribbon cartridge form the outsides of the overall housing. Whereas, in the known apparatus initially described above, namely, the respective housing is already fashioned as an overall housing and contains specifically fashioned receptacle spaces for the acceptance of the appertaining ribbon cartridges, the ribbon cartridge and the housing in the apparatus of the invention each form autonomous modules that not only functionally but also structurally supplement one another when joined to form the overall apparatus. The ribbon cartridge and the housing are thereby preferably matched to one another such with respect to their outside dimensions that those sides of the ribbon cartridge and of the housing forming the outsides of the overall housing align at least approximately free of offset in the region of their joining.

In view of the guidance of the recording sheet to be printed inside the ribbon cartridge, it is provided according to a preferred development of the apparatus of the invention that an opening for transferring the recording sheet into the ribbon cartridge, the pressure member, and an opening for transferring the recording sheet out of the ribbon cartridge are arranged in the ribbon cartridge in planes lying above one another. A compact structure of the apparatus of the invention is achieved on the basis of this design because the recording sheet is conducted inside the ribbon cartridge from a feed plane into another plane in which it is printed and is transferred from the latter into a deposit plane. In the framework of the invention, accordingly, the inner structure of the housing is also divided into three planes lying above one another in an especially compact way, whereby the sheet feeder means, the recording head comprising an electrical control means, and the sheet deposit means are arranged in the housing in planes lying above one another. As a result of this layered structure, an extremely compact housing can be realized for the apparatus of the invention, the ground plan of this housing being essentially determined only by the format of the recording sheets employed. The sheet feeder means, the recording head comprising the control means, and the sheet deposit means thereby lie above one another in the same sequence in which the opening for transferring the recording sheet into the ribbon cartridge, the pressure member and the opening for transferring the recording sheet out of the ribbon cartridge are arranged in the ribbon cartridge. The recording head comprising the control means can lie under or between the planes having the sheet feeder and sheet deposit means, whereby the sheet deposit means preferably lies in the uppermost plane in order to enable a simple removal of the printed recording sheet or the attachment of, for example, a sheet sorting means. In a known way, the sheet feeder means preferably contains a sheet supply cassette comprising a single-sheet conveying means (feeder). When the sheet feeder means is arranged in the lowest plane, then, for example, it can be downwardly supplemented by additional sheet supply cassettes in an unproblematical way.

As regards the arrangement of the recording head and of the control means, the recording head is advantageously held in the edge region of a printed circuit board carrying the control means. In space-saving fashion, the printed circuit board thereby lies in the intervening plane between the sheet feeder means and the sheet deposit means or lies under both devices and comprises a format at least approximately corresponding to the format of the recording sheets. Over and above this, the mounting of the recording head in the edge region of the printed circuit board can be realized structurally in an especially simple way.

In order to enable a conveying of the recording sheet to be printed inside the ribbon cartridge, a development of the apparatus of the invention correspondingly provides that a motor drive unit comprising a coupling part at the drive side is arranged in the housing in the region of the connection to the ribbon cartridge; and that the ribbon cartridge comprises a coupling part at the driven side that is connected to conveying means for conveying the recording sheet and the inked ribbon inside the ribbon cartridge. When attaching the ribbon cartridge to the housing, the two coupling parts engage in one another, so that a conveying of the recording sheet inside the ribbon cartridge is enabled proceeding from the motor drive in the housing. Rollers having parallel axes thereby come into consideration as conveying means inside the ribbon cartridge, the recording sheet being conveyed between these rollers. In this context, the pressure member itself is preferably fashioned as conveying means for the recording sheet and the inked ribbon, being fashioned in the form of a printing roller. In that the inked ribbon is conducted past the recording head in common with the recording sheet, additional conveying means for the inked ribbon are therefore not required. When storing the inked ribbon on at least two winding reels with axes parallel to the pressure member, however, it is advantageous that at least the take-up reel is mechanically connected to the coupling part of the ribbon cartridge at the driven side, being mechanically connected thereto as conveying means for the inked ribbon; what this enables is not so much a conveying of the inked ribbon as that the used section of inked ribbon is continuously taken up in order to prevent a jamming of the inked ribbon.

As already set forth, the recording sheet introduced into the ribbon cartridge for printing in the apparatus of the invention is conducted to the pressure member inside the ribbon cartridge by means of the sheet guiding means and is thereby conducted past the recording head in order, subsequently, to be in turn conducted out of the ribbon cartridge. To this end, the ribbon cartridge is preferably constructed such that the sheet guiding means comprises two guide elements that extend between the opening for transferring the recording sheet into the ribbon cartridge and a location for placing the sheet against the pressure member or, respectively, between the sheet placement location and the opening for transferring the recording sheet out of the ribbon cartridge, extending arcuately upon formation of a respective acceptance space for the inked ribbon. The recording sheet to be printed that comes from the sheet feeder means is first conducted by the guide elements past the acceptance space for the inked ribbon supply and—relative to the recording head—is brought to the back region of the pressure member, so that the recording sheet, pressing directly against the pressure member for image recording, is conducted past the pressure member and the inked ribbon at the recording head; from there, the recording sheet is conducted past the acceptance space for the used inked ribbon and is conducted out of the ribbon cartridge on to the sheet deposit means of the housing. In addition, individual recording sheets that are to be printed can, proceeding from the sheet deposit means, be introduced into the ribbon cartridge through that opening of the ribbon cartridge lying opposite, being introduced to the sheet placement location of the pressure member where the recording sheet is conducted past the recording head together with the inked ribbon and is subsequently returned to the sheet deposit means on the same path.

In an especially advantageous improvement of the apparatus of the invention, a controllable shunt is arranged in the course of the sheet guiding means between the pressure member and the opening for transferring the recording sheet out of the ribbon cartridge; a sheet guidance channel branching off from the sheet guiding means and returning loop-like to the sheet placement location of the pressure member is arranged following the shunt. As a result thereof, a multiple, particularly varicolored printing of the recording medium is enabled in that the recording sheet coming from the recording head and printed with a sub-image is steered into the sheet guidance channel by the controllable shunt and is brought back to the pressure member and the recording head for printing the next sub-image; when the last sub-image is printed, the shunt is switched so that the completely printed recording sheet is transferred out of the ribbon cartridge onto the sheet deposit means of the housing. As a result of the loop-shaped fashioning of the sheet guidance channel, the start of the sheet is conducted to the sheet placement location of the pressure member immediately after the end of the sheet of the recording sheet has passed by the recording head at the end of the printing of a sub-image given multiple printing of the recording sheet and printing the next sub-image can thus be begun; the time spans between the printing of two successive sub-images can thus be reduced to negligibly low values, so that a high printing speed is achieved. The length of the sheet guider channel with reference to the length of the recording sheet is thereby dimensioned such that a part of the recording sheet lies against the sheet recording head in the region between the sheet placement location and the sheet deposit location at all times, so that the recording sheet is constantly conveyed by the printing roller when the pressure member is fashioned as a printing roller, no additional conveying means being required for this purpose A control of the shunt proceeding from the central control means in the housing is advantageously enabled in that the controllable shunt is connectable to the control means in the housing via a coupling in the region of the connection of the ribbon cartridge to the housing. The shunt itself can thereby comprise an electro-motive drive that is electrically connected to the control means in the housing via the coupling; preferably, however, the electro-motive drive for the shunt is provided as a component part of the control means in the housing and is mechanically coupled to the shunt via the coupling.

Alternatively to the electrical control, a purely mechanical control of the shunt is advantageously enabled in that the shunt has its control side connected to a stepping feed mechanism that is pawlable in accord with the number of revolutions of the recording sheet in the sheet guidance channel. Dependent, for example, upon whether only the individual colors yellow, magenta and cyan are to be successively printed for multicolor printing or whether the color black is also to be additionally printed for enhancing the contrast, the stepping feed mechanism has three or four switch positions. For controlling the shunt, the stepping feed mechanism can, for example, comprise an eccentric cam that turns by a defined angle given every feed or switching step, whereby the shunt is deflected by the cam.

In accord with a preferred fashioning of the apparatus of the invention, the stepping feed mechanism is composed of a toothed roller having a number of teeth corresponding in number to the plurality of prescribed switch or feed positions, respectively one tooth thereof extending to such an extent into the conveying path for the recording sheet in front of the shunt in every switch or feed position that the stepping feed mechanism is pawled or forwarded by respectively on switch position by the start of the sheet of the respectively in-coming recording sheet. The start of the recording sheet conveyed from the recording head in the direction toward the shunt strikes the respectively projecting tooth of the toothed roller and turns this by a prescribed angular amount into the next switch position for advancing the shunt; an actuation of the shunt that is especially simple and reliable in control-oriented terms ensues in this way.

BRIEF DESCRIPTION OF THE DRAWINGS

The figures of the drawing shall be referred to below for explaining the invention. Shown in detail are.

DESCRIPTION OF THE PREFERRED EMBODIMENTS

Figure 1:
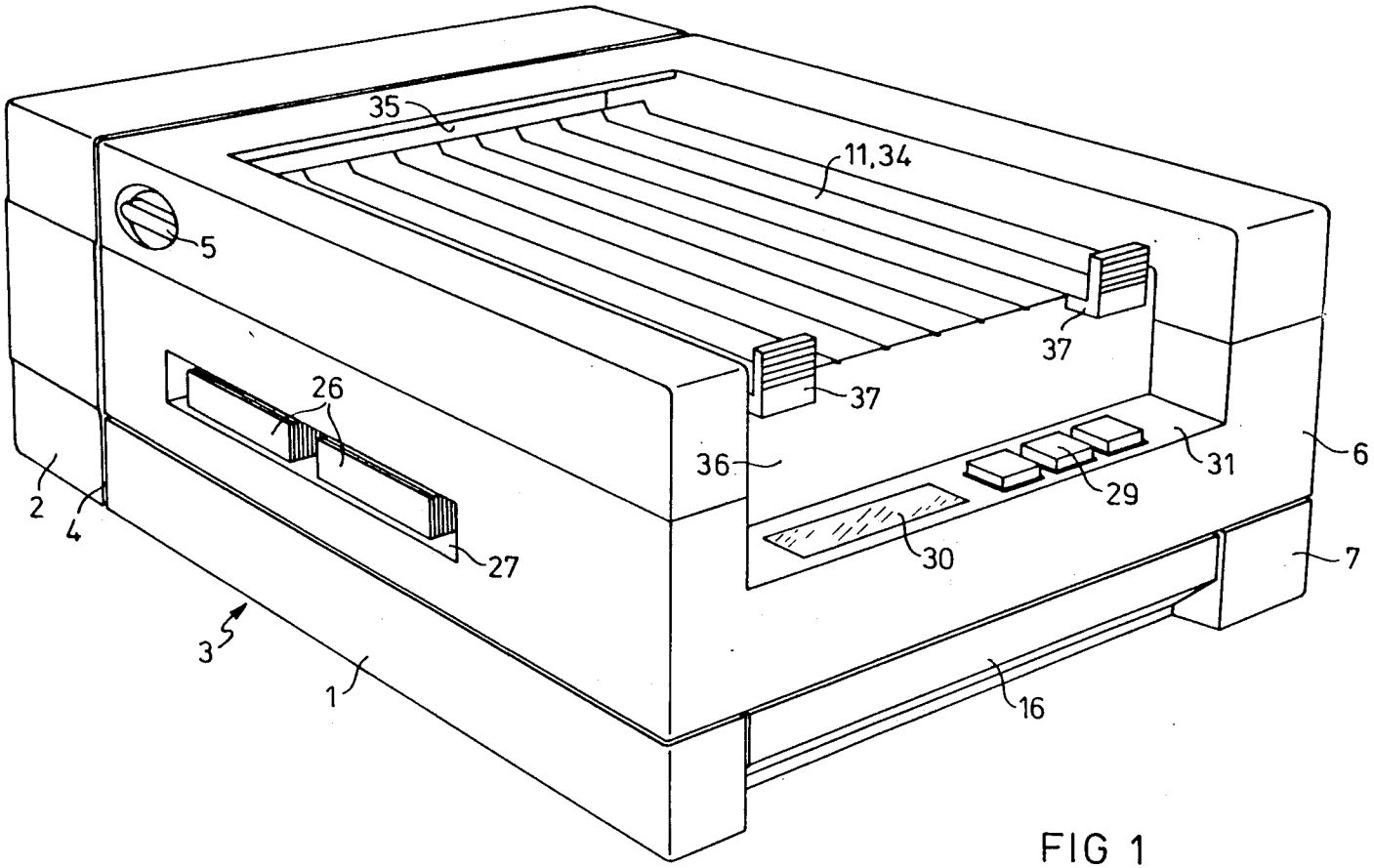
FIG. 1 an exemplary embodiment of the apparatus of the invention in a perspective view.

FIG. 1 shows a thermal transfer printer as a preferred exemplary embodiment of the apparatus of the invention for recording image information on a recording sheet.

Figure 2:
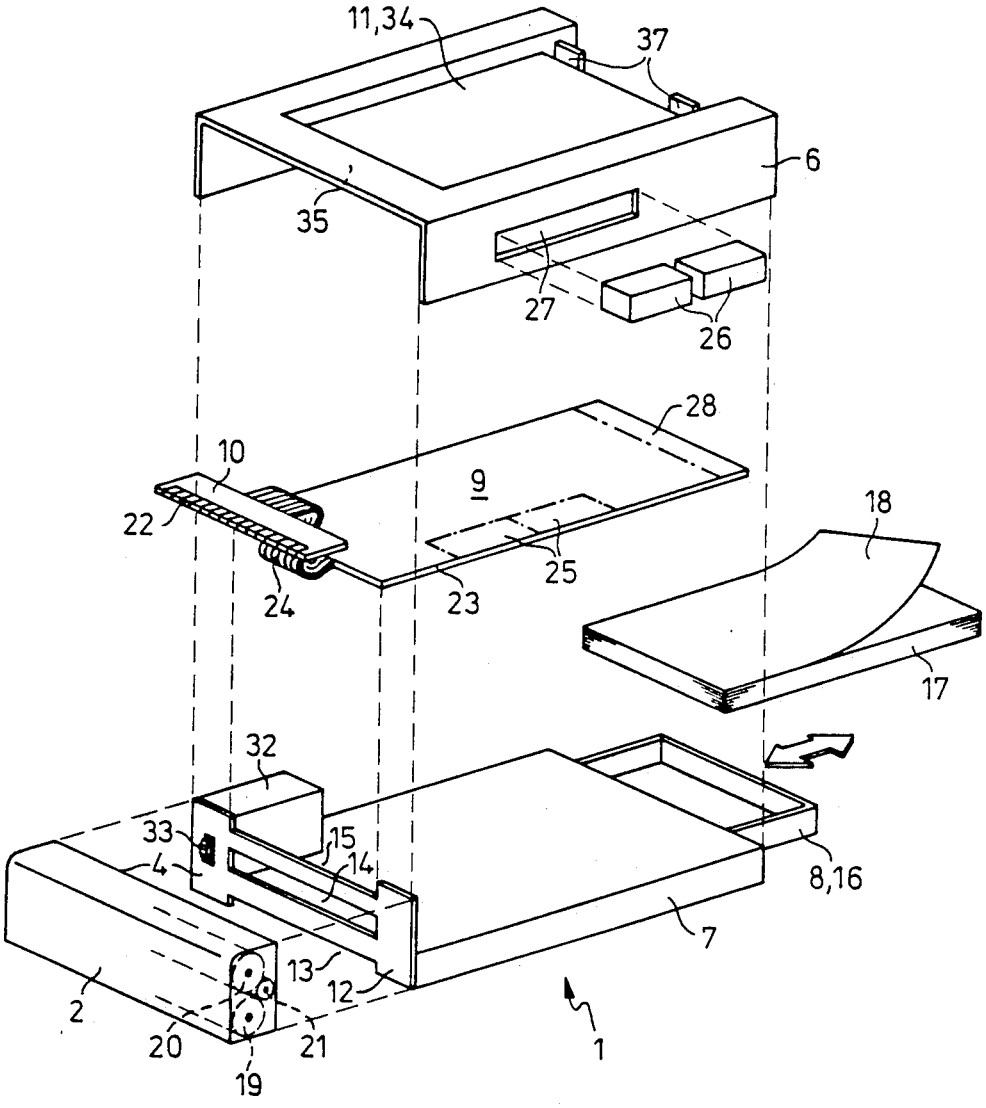
FIG. 2 significant individual parts of the exemplary embodiment of FIG. 1, each shown in a schematic view separately from one another.

FIG. 2 provides an overview of the essential parts of the thermal transfer printer. In this thermal transfer printer, the image recording ensues in such fashion that the individual recording sheets composed of plain paper are brought into contact with a heat-sensitive inked ribbon and, due to punctiform heating of the inked ribbon, pigments contained therein are transferred, likewise punctiform, onto the paper recording sheet. It should be realized that the thermal transfer printing here merely represents an example of many different printing methods that can be utilized in the apparatus of the invention.

FIG. 1 shows a housing 1 and a ribbon cartridge 2 plugged thereonto that forms the overall housing 3 of the thermal transfer printer together with the housing 1. The ribbon cartridge 2 and the housing 1 thereby each have one side joined to one another upon formation of a connecting interface 4, whereas all other sides of the ribbon cartridge 2 and of the housing 1 form the outsides of the overall housing 3. As FIG. 1 shows, those sides of the ribbon cartridge 2 and of the housing 1 forming the outsides of the overall housing 3 align with one another nearly free of offset, so that a uniform overall impression arises. A rotary lever 5 for manually locking or unlocking the ribbon cartridge 2 joined to the housing 1 is positioned in an outside wall of the housing 1.

Additionally to FIG. 1, FIG. 2 shows the ribbon cartridge 2 detached from the housing 1 and shows significant parts of the housing 1 separated from one another in an exploded view. The housing 1 comprises an upper housing part 6 in the fashion of a hood that is put in place on a lower housing part 7. A sheet feeder means 8 in a lowest plane, a control means 9 for the thermal transfer printer as well as a line-shaped recording head 10 in a plane lying thereabove, and a sheet deposit means 11 in an uppermost plane are fashioned in the housing 1. In the region of the connection 4 to the ribbon cartridge 2, the housing 1 is limited by a housing wall 12 that comprises three openings 13, 14 and 15 in the direction toward the ribbon cartridge 2 lying above one another in accord with the position of the three, above-referenced planes.

The sheet feeder means 8 is integrated in the lower housing part 7 and is composed of a sheet supply cassette 16 removable from the lower housing part 7 for the acceptance of a stack 17 of recording sheets 18 to be printed and of a single-sheet feeder means (not visible here) for isolating the recording sheet 18 from the stack 17 and for conveying the isolated recording sheets 18 through the lowest opening 13 in the housing wall 12 into the ribbon cartridge 2. As a result of the arrangement of the sheet feeder means 8 in the lower housing part 7, further sheet feeder means (feeders) can be attached without further ado in downward direction.

In the inside of the ribbon cartridge 2, the recording sheet 18 together with an inked ribbon stored on two winding reels 19 and 20 having parallel axes are conducted past a pressure member 21 extending parallel to the winding reels 19 and 20, being thus conducted with a sheet guide means to be set forth in greater detail later. The pressure member 21 can be fashioned as an immobile pressure part as in the illustrated exemplary embodiment, however, it is preferably composed of a printing roller. With respect to one another, the pressure member 21 and the recording head 10 are arranged such in the ribbon cartridge 2 or, respectively, in the housing 1 that, when the ribbon cartridge 2 is plugged to the housing 1, the line-shaped recording head 10 extends through the opening 14 in the housing wall 12 and presses against the pressure member 21 upon interposition of the inked ribbon and of the recording sheet 18 to be printed. The pressure member 21 projects out of the ribbon cartridge 2 in the direction toward the recording head 10, so that the recording head 10 can be arranged correspondingly recessed in the housing 1 and, thus, is protected when the ribbon cartridge 2 is changed.

For printing the recording sheet 18, the recording head 10 comprises a plurality of heating elements 22 lying next to one another and individually controllable which, when driven, produce a selective color transfer from the inked ribbon on to the recording sheet 18. The heating elements 22 of the recording head 10 are thereby individually driven by the control means 9 that is constructed on a printed circuit plate 23 in terms of circuit technology. Given the exemplary embodiment shown in FIG. 2, the recording head 10 is connected to the printed circuit board 23 in the edge region thereof via flexible leads 24; however, it is also possible to secure the recording head 10 directly to the edge of the printed circuit board 23, so that an additional mounting for the recording head is superfluous.

Plug-in locations 25 for individual script or front) modules 26 are provided in a lateral region of the printed circuit board 23, these script modules 26 (as shown in FIGS. 1 and 2) being pluggable onto the printed circuit board 23 through a lateral opening 27 in the upper housing part 6. The script modules 26 each contain a pre-programmed character set for a specific type of script with whose assistance the recording head 10 is driven for recording data in the selected type of script. Connecting locations 28 for operating elements 29 and display elements 30 that are arranged in freely accessible fashion in a control panel 31 (FIG. 1) in the back region of the housing 1 are provided in a back part of the printed circuit board 23 with reference to the position of the recording head 10.

The control means 9 on the printed circuit board 23 further respectively comprises the drive for a motor drive unit 32 arranged in the inside of the housing 1 for the single-sheet feeder means (not shown) of the sheet feeder means 8 and conveying means inside the ribbon cartridge 2 for conveying the recording sheet 18. In the illustrated exemplary embodiment of the apparatus of the invention, the conveying means inside the ribbon cartridge 2 is composed of the pressure member 21 fashioned as a printing roller that, when the ribbon cartridge 2 is plugged to the housing 1, is connected to the motor drive unit 32 in the housing 1 via coupling parts in the region of the connection interface 4. Of these coupling parts, only a coupling part 33 at the drive side, fashioned as a gearwheel, can be seen at the housing 1 in FIG. 2, whereas a corresponding coupling part at the driven side at the ribbon cartridge 2 is not visible.

After it has been printed, the recording sheet 18 lying against the pressure member 21 in the ribbon cartridge 2 and printed by the recording head 10 in the housing 1 is conveyed from the ribbon cartridge 2 through the opening 15 in the housing wall 12 onto the sheet deposit means 11 of the housing 1, being conveyed by the driven printing roller 21. The sheet deposit means 11 is composed of a shallow sheet acceptance trough 34 fashioned on the upper side of the upper housing part 6 onto which the recording sheet 18 conveyed into the inside of the housing 1 proceeds passing through a sheet ejection opening 35. A grasping trough 36 (FIG. 1) for grasping the recording sheet 18 deposited in the sheet acceptance trough 34 is fashioned in the back region of the housing 1; two detents 37 in this region prevent the recording sheet 18 from falling down out of the sheet acceptance trough 34.

Figure 3:
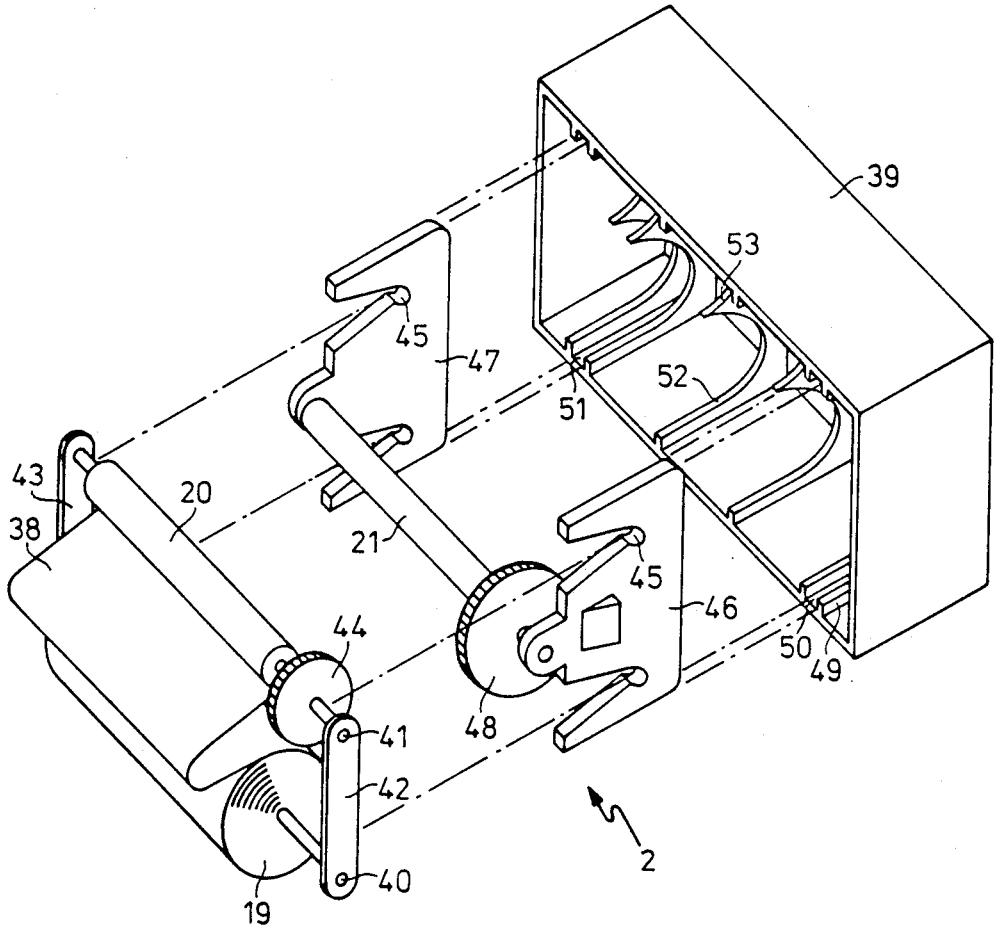
FIG. 3 significant component parts of a ribbon cartridge of the type provided in the exemplary embodiment of FIGS. 1 and 2.

FIG. 3 shows the arrangement of the pressure member 21 fashioned as printing roller and of the winding reels 19 and 20 for the inked ribbon (referenced 38) in a cartridge housing 39 of the ribbon cartridge 2. The two winding reels 19 and 20 are rotatably seated on two shafts 40 and 41 lying one above the other which have their respectively adjacent ends seated parallel to one another in two bearing members 42 and 43. The upper winding reel 20 serves as take-up reel and therefore comprises a drive gearwheel 44 held secure against turning on its shaft 41. Together with the bearing members 42 and 43, the winding reels 19 and 20 form a replaceable unit that can be easily introduced into the ribbon cartridge 2, so that a change of ribbon does not necessarily require a change of ribbon cartridge. Given a multiply employable inked ribbon (multi-use), further, it is possible to remove this unit from the cartridge housing 39 after multiple use, to turn it over and to re-introduce it or, for example for direct thermal printing, to replace the inked ribbon 38 with a heat-sensitive recording medium on two winding reels in the cartridge housing 39. Together with their shafts 40 and 41, both winding reels 19 and 20 are introducible into correspondingly fashioned receptacle slots 45 of two mounting parts 46 and 47 between which the pressure member 21 fashioned as a printing roller is rotatably seated in common with a coupling part 48 at the driven side in the form of a gearwheel. Upon introduction of the shafts 40 and 41 of the winding reels 19 and 20 into the receptacle slots 45 of the two mounting parts 46 and 47, the printing roller 21 ends up in the region between the two winding reels 19 and 20, whereby the winding reels 19 and 20 and the printing roller 21 are aligned with their axes parallel to one another and the coupling part 48 at the driven side engages into the drive gearwheel 44 for the take-up reel 20. The cartridge housing 39 of the ribbon cartridge 22 comprises grooves 50 and 51 at its inside walls limited by guide ribs 49, these grooves 50 and 51 serving for the acceptance of the mounting parts 46 and 47 with the winding reels 19 and 20 and the printing roller 21. Further, the cartridge housing 39 contains a sheet guide means composed of two guide elements 52 and 53 that each extend arcuately around the two winding reels 19 and 20.

Figure 4:
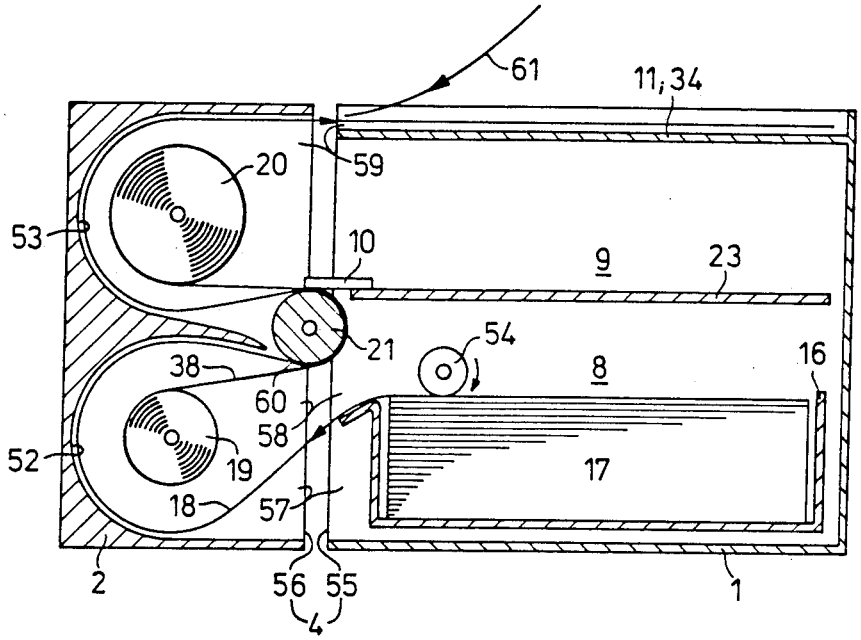
FIG. 4 a schematic view of a longitudinal section through the exemplary embodiment of FIGS. 1 and 2.

FIG. 4 shall be referenced below for explaining the functioning of the apparatus of the invention, this FIG. 4 showing a schematic view of a section proceeding through the exemplary embodiment of the apparatus of the invention shown in FIGS. 1 and 2 that proceeds perpendicular to the line-shaped recording head 10. As was already shown with reference to FIG. 2, the housing 1 contains the sheet feeder means 8 in the lowest level, this sheet feeder means 8 being composed of the sheet supply cassette 16 that contains a stack 17 of recording sheets 18, and of a single-sheet feeder means 54; the latter is composed of a sheet feeder roller that is driven by the motor drive unit 32 shown in FIG. 2 under the control influence of the control means 9. The printed circuit board 23 that carries the control means 9 for the overall apparatus and carries the line-shaped recording head 10 at its edge region facing toward the ribbon cartridge 2 is arranged in the inside of the housing 1 in a plane above the sheet feeder means. The sheet deposit means 11 in the form of the sheet acceptance trough 34 is fashioned in an uppermost plane of the housing 1.

As already shown in FIG. 3, the ribbon cartridge 2 contains the two winding reels 19 and 20 lying one above the other on which the inked ribbon 38 is stored and contains the pressure member 21 in the form of the printing roller that is arranged between the two winding reels 19 and 20. The ribbon cartridge 2 further contains the sheet guide means composed of the two guide elements 52 and 53 each of which extends arcuately around the two winding reels 19 and 20. Both the housing 1 as well as the ribbon cartridge 2 are each closed toward the outside with the exception of a single side 55 or, respectively, 56; the two open sides 55 and 56 form the connection interface 4 at which the ribbon cartridge 2 is plugged to the housing 1, whereby a residual gap between the housing 1 and the ribbon cartridge 2 is shown in FIG. 4 merely for reasons of clarity. Corresponding to the position of the three planes lying on top of one another for the sheet feeder means 8, for the recording head 10 comprising the control means 9, and for the sheet deposit means 11, the two open sides 55 and 56 of the housing 1, or, respectively, of the ribbon cartridge 2 facing toward one another respectively comprise from bottom to top: an opening 56 for transferring the recording sheet 18 out of the housing 1 with the single-sheet feeder means 54 into the ribbon cartridge 2, an opening 58 for both-sided access of the pressure member 21 and of the recording head 10 to one another, and an opening 59 for transferring the recording sheet 18 out of the ribbon cartridge 2 onto the sheet deposit means 11 of the housing 1. Of the guide elements 52 and 53 arranged inside the ribbon cartridge 2, the guide element referenced 52 proceeds between the opening 57 and a sheet placement location 60 of the printing roller 21, and the guide element reference 53 proceeds from the sheet placement location 60 of the printing roller 21 up to the opening 59.

On the basis of the drive by the control means 9, the sheet conveying roller of the single-sheet feeder means 54 turns in clockwise direction, whereby the uppermost recording sheet 18 is conducted away from the stack 17 out of the housing 1 into the ribbon cartridge 2 between the guide element 52 and the winding reel 19. The recording sheet 18 thereby has its sheet beginning guided along the guide element 52 up to the sheet placement location 60 of the printing roller 21 where the recording sheet 18 has its beginning inserted between the printing roller 21 and the inked ribbon section extending between the winding reels 19 and 20 over the printing roller 21. Due to the rotation of the printing roller 21 that, according to the illustrations in FIGS. 2 and 3, is driven by the motor drive unit 32 in the housing 1 via the coupling parts 33 and 48, the recording sheet 18, lying against the printing roller 21 together with the inked ribbon 38, is conducted past the recording head 10 and is printed by selective drive of the individual heating elements 22 of the recording head 10. Following the recording head 10, the inked ribbon 38 is wound up by the take-up reel 20, whereas the recording sheet 18 has its beginning gliding along the guide element 53 and the latter conducts it through the opening 59 out of the ribbon cartridge 2 onto the sheet deposit means 11 of the housing 1. When only a single recording sheet 61 is to be printed, then, in the region of the sheet deposit means 11, this can be introduced through the opening 59 into the ribbon cartridge 2, whereby the recording sheet has its beginning conducted to the sheet placement location 60 of the printing roller 21 by the guide element 53; after being printed, the individual recording sheet 61 is conducted back onto the sheet deposit means 11 along the guide element 53. When a recording sheet 18 that has been printed and is conveyed onto the sheet deposit means 11 is also to be printed on its back side, then, as set forth for the single sheet 61, it can be returned into the ribbon cartridge 2 through the opening 59. When the inked ribbon 38 stored in the ribbon cartridge 2 is used up, then the winding reels 19 and 20 are replaced by new winding reels or the ribbon cartridge 2 is simply detached from the housing 1 and a new ribbon cartridge is attached to the housing 1. Both functionally as well as structurally, the housing 1 and the ribbon cartridge 2 supplement one another to form the apparatus of the invention, whereby the outsides of the housing 1 and of the ribbon cartridge complement one another to form the outside surfaces of the overall housing 3 of the apparatus of the invention.

Figure 5:
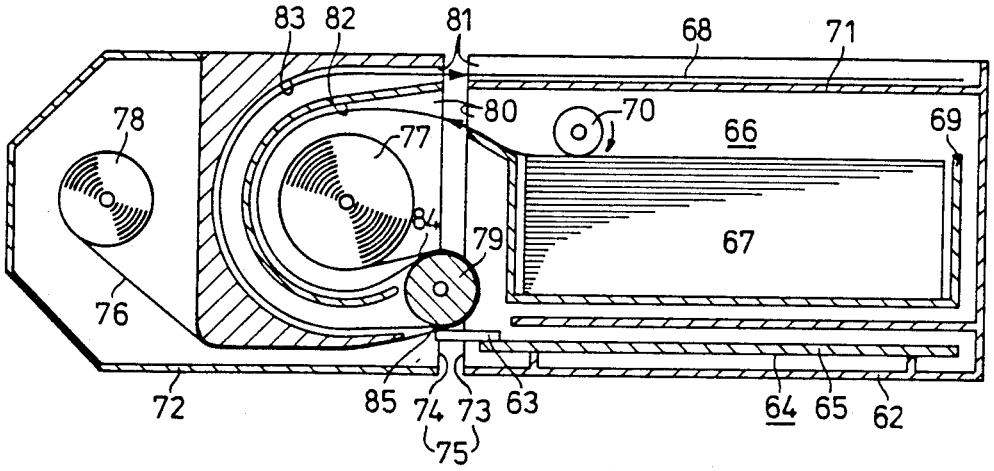
FIG. 5 a corresponding longitudinal section through a further exemplary embodiment of the apparatus of the invention.

FIG. 5 schematically shows a further exemplary embodiment of the apparatus of the invention in a section perpendicular to the line course of the recording head. A ribbon cartridge 72 is pluggably held at a housing which, in three planes lying one above the other from bottom to top, contains a line-shaped recording head 63 with appertaining control means 64 on a printed circuit board 65, a sheet feeder means 66 composed of a sheet supply cassette 69 containing a stack 67 of recording sheets 68 and of a single-sheet feeder means 70 fashioned as a roller, and, at the top, contains a sheet deposit means 71. To that end, the housing 62 and the ribbon cartridge 72 each have a single, open side 73 or, respectively, 74 held against one another upon formation of a connection interface 75, whereas all other, closed sides of the housing 62 and of the ribbon cartridge 72 form the outsides of an overall housing of the apparatus modularly composed of the housing 62 and of the ribbon cartridge 72. The housing 62 and the ribbon cartridge 72 are shown not completely joined to one another only for reasons of clarity.

The ribbon cartridge 72 contains an inked ribbon 76 on two winding reels 77 and 78 that, with respect to the direction in which the ribbon cartridge 72 is plugged to the housing 62, are arranged lying behind one another and having their axes parallel to one another. An extremely flat and thin structure of the ribbon cartridge 72 and, thus, of the overall apparatus thereby derives. Further, the ribbon cartridge 72 contains a pressure member 79 fashioned as a printing roller in such an arrangement that, when the housing 62 and the ribbon cartridge 72 are joined, the recording head 63 lies against the pressure member 79; to this end, both the housing 62 as well as the ribbon cartridge 72 comprise a respective opening (not referenced here) in their sides 73 or, respectively, 74 forming the connection interface 75, these openings enabling a both-sided access of the recording head 63 and of the pressure member 79 to one another. The sides 73 and 74 of the housing 62 or, respectively, of the ribbon cartridge 72 further contain an opening 80 lying opposite the sheet feeder means 66 for transferring the recording sheet 68 out of the housing 62 into the ribbon cartridge 72 as well as an opening 81 lying opposite the sheet deposit means 71 for transferring the recording sheet 68 out of the ribbon cartridge 72 into the housing 62. A sheet guide means composed of two guide elements 82 and 83 is arranged inside the ribbon cartridge 72, the guide element thereof referenced 82 extending from the opening 80 arcuately around the winding reel 77 up to a sheet placement location 84 against the pressure member 79 and the guide element thereof referenced 83 proceeding from a sheet deposit location 85 at the pressure member 79 up to the opening 81 likewise in an outer arc around the winding reel 77. The exemplary embodiment of the apparatus of the invention shown in FIG. 5 thus differs from the exemplary embodiment shown in FIG. 4 only on the basis of a modified sequence of the arrangement of the recording head 63 with the appertaining control means 64, of the sheet feeder means 66 and of the sheet deposit means 71 in the housing 62 and on the basis of a corresponding arrangement of the winding reels 77 and 78 and of the pressure member 79 inside the ribbon cartridge 72, whereby an especially flat structure of the apparatus of the invention is enabled; the functioning of the exemplary embodiment of FIG. 5, by contrast, is the same as in the exemplary embodiment shown in FIG. 4. The single-sheet feeder means 70 thus transfers the recording sheet 68 from the stack 67 into the ribbon cartridge 72, whereby the beginning of the recording sheet 68 is conducted along the guide element 82 up to the sheet placement location 84 against the pressure member 79. There, the beginning of the recording sheet 68 proceeds between the pressure member 79 and the inked ribbon 76 lying thereagainst, so that the recording sheet 68 and the inked ribbon 76 are conducted past the recording head 63 in common. Following the recording head 63, the inked ribbon 76 is separated from the recording sheet 68 in the region of the sheet deposit location 85, whereby the inked ribbon 76 is wound up by the take-up reel 78 and the recording sheet 68 is conducted along the guide element 83 out of the ribbon cartridge 67 onto the sheet deposit means of the housing.

Figure 6:
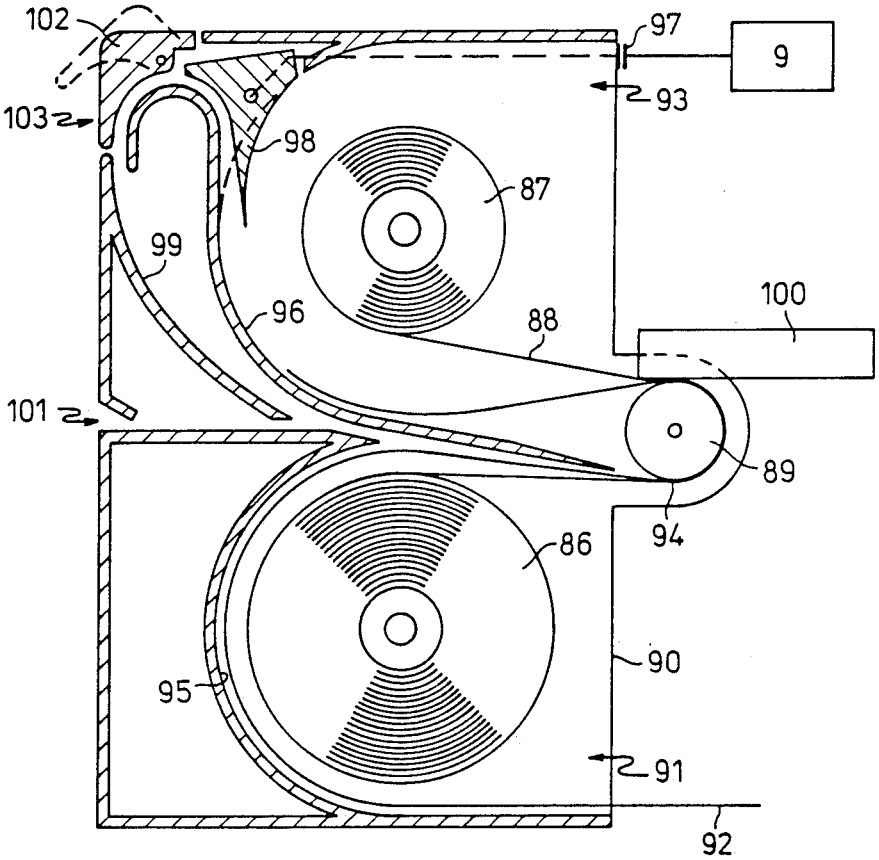
FIG. 6 a schematic view of a section through a preferred embodiment of the ribbon cartridge shown in FIG. 4 comprising a controllable shunt.

FIG. 6 shows a preferred development of the ribbon cartridge 2 shown in FIG. 4 which also enables a multiple printing of the recording sheet 18. The ribbon cartridge shown in FIG. 6, just like the ribbon cartridge of FIG. 4, comprises two winding reels 86 and 87 lying on top of one another for an inked ribbon 88. A pressure member 89 in the form of a printing roller axially parallel to them is arranged between the two winding reels 86 and 87, the inked ribbon section respectively situated between the two winding reels 86 and 87 being conducted around this pressure member 89. An opening 91 for transferring a recording sheet 92 into the ribbon cartridge as well as a further opening 93 for transferring the recording sheet 92 out of the ribbon cartridge above the pressure member 89 are fashioned in a side 90 of the ribbon cartridge forming the interface to the housing (not shown here). A guide element 95 extends around the winding reel 86 inside the ribbon cartridge between the opening 91 and a sheet placement location 94 against the pressure member 89. A further, arcuate guide element 96 extends around the winding reel 87 between the opening 93 and the sheet placement location 94. In the course of the guide element 96, a controllable shunt 98 connected to the control means 9 in the housing 1 (FIG. 2) via an electrical contact of a coupling 97 is arranged, a sheet guidance channel 99 branching off from the guide element 96 following this controllable shunt 98 and returning loop-like to the sheet placement location 94 of the pressure member 89. Dependent on the position of the controllable shunt 98, the recording sheet 92 printed by a recording head 100 is guided either in the direction toward the opening 93 for transfer of the recording sheet 92 out of the ribbon cartridge or is introduced into the loop-shaped sheet guidance channel 99 and is supplied to the pressure member 89 for renewed printing.

When, thus, the recording sheet 92 is to be multiply printed, particularly in multi-colored fashion, then the control means 9 of the apparatus drives the controllable shunt 98 into the position shown with solid lines in FIG. 6. The recording sheet 92 supplied to the printing roller 89 via the opening 91 along the guide element 95 is conducted past the recording head 100 by the rotation of the printing roller 89 and is thereby printed with a first sub-image. As a result of the position of the controllable shunt 98, the recording sheet 92 coming from the pressure member 89 has its beginning conducted into the loop-shaped sheet guidance channel 99 and is again brought to the sheet placement location 94 of the pressure member 89. The length of the loop-shaped sheet guidance channel 99 is thereby dimensioned such that the beginning of the recording sheet 92 reaches the sheet placement location 94 before the end of the recording sheet 92 leaves the pressure member 89 at its sheet deposit location 96. The recording sheet 92 is now conducted past the recording head 100 a second time and is thereby printed with the second sub-image. This operation is repeated until the beginning of the printing of the last sub-image. The controllable shunt 98 is then driven into the shunt position shown with broken lines, so that the recording sheet 92 is conveyed out of the ribbon cartridge through the opening 93.

In its front outside, the illustrated ribbon cartridge comprises a sheet introduction slot 101 through which recording sheets to be individually printed and special formats such as, for example, envelopes, can be guided directly to the sheet placement location 94 of the pressure member 89. The printed recording sheets can also be individually directly removed from the ribbon cartridge in that, by actuating a flap 102 in the region of the transition from the guide element 96 into the sheet guidance channel 99, a sheet ejection slot 103 is released.

Figure 7:
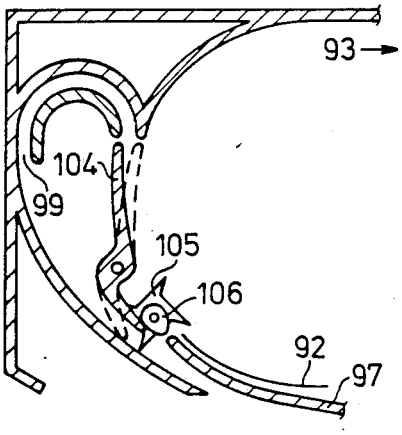
FIG. 7 a modification of the controllable shunt shown in FIG. 6.

FIG. 7 shows a schematic view of a modified embodiment of the ribbon cartridge shown in FIG. 6 in the region of the controllable shunt. In this embodiment, a stepping feed mechanism 105 is arranged in the course of the guide element 97 immediately in front of a shunt 104, this stepping feed mechanism 105—via a cam 106—driving the shunt 104 either into a switch position steering the incoming recording sheet 92 into the sheet guidance channel 99 or into a switch position forwarding the recording sheet 92 in the direction toward the opening 93. The stepping feed mechanism 105 is fashioned as a toothed drum whose teeth project into the region of the sheet guidance immediately in front of the shunt 104 in every switch position of the stepping feed mechanism 105. The beginning of the recording sheet 92 coming from the sheet deposit location 96 of the pressure member 89 (FIG. 6) therefore strikes against one of the teeth of the toothed roller 105 and turns this by one switch position. With respect to its eccentricity, he cam 106 held at the toothed roller 105 is fashioned such that, given three switch positions of the stepping feed mechanism 105, it drives the shunt 104 into a shunt position that steers the recording sheet 92 into the loop-shaped sheet guidance channel 99; in the fourth switch position of the stepping feed mechanism 105, the shunt 104 is driven into the shunt position shown with broken lines in which the recording sheet 92 is conducted in the direction toward the opening 93 for transferring the recording sheet 92 out of the ribbon cartridge 2. As a result of its four different switch positions, the stepping mechanism 105 is especially suitable when the four colors yellow, magenta, cyan and black are to be successively printed for colored printing of the recording sheet 92. In this case, the inked ribbon contained in the ribbon cartridge is continuously provided with color sections in the said colors.

Different, correspondingly fashioned ribbon cartridges that can be plugged to the housing of the apparatus dependent on the desired function can be provided for the possibilities provided in the above-described exemplary embodiments for guidance of the recording sheet to be printed inside the ribbon cartridge, such as, for example, the shunt for a multiple or multi-colored printing of the recording sheet or the additional sheet introduction and sheet ejection slots for printing individual recording sheets. This is also true of ribbon cartridges that are designed for special formats of the recording sheets. The inked ribbon stored in the ribbon cartridge can be replaced in a simple way after detaching the ribbon cartridge from the housing of the apparatus.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. An apparatus for recording image information on a recording sheet with a linear recording head arranged in a housing of the apparatus and with a ribbon cartridge that is connectable with the housing, said ribbon cartridge containing a contact pressure member and an ink ribbon which can be directed in sections past the recording head transversely relative to the linear direction with the recording sheet as an intermediate layer, thereby residing against the contact pressure member; comprising the improvement wherein the ribbon cartridge and the housing are connectable parts of an overall housing, which are neighboring each other with one single side respectively, such that all the other sides of the housing and of the ribbon cartridge constitute the outer sides of the overall housing; including a sheet feeder means and a sheet deposit means arranged in the housing; and a sheet guidance means contained in the ribbon cartridge which proceeds between the contact pressure member and the sheet feeder means on the one hand, and the sheet deposit means on the other hand, said sheet guidance means serving the purpose of guiding the recording sheet coming from the sheet feeder means out of the housing into the ribbon cartridge to the contact pressure member and from there out of the ribbon cartridge into the housing to the sheet deposit means.

2. An apparatus according to claim 1, wherein those sides of the ribbon cartridge and of the housing forming the outside of the overall housing align with one another at least approximately without offset in a region of the connection of the ribbon cartridge to the housing.

3. An apparatus according to claim 1, wherein an opening for transferring the recording sheet into the ribbon cartridge, an opening for the pressure member and an opening for transferring the recording sheet out of the ribbon cartridge are arranged in the ribbon cartridge in planes lying one above the other.

4. An apparatus according to claim 1, wherein the sheet feeder means, the recording head comprising an electrical control means and the sheet deposit means are arranged in the housing in planes lying one above the other.

5. An apparatus according to claim 4, wherein the recording head is held at the edge region of a printed circuit board carrying the control means.

6. An apparatus according to claim 1 wherein a motor drive unit comprising a drive coupling part at a drive side thereof is arranged in the housing in the region of the connection to the ribbon cartridge and wherein the ribbon cartridge comprises a driven coupling part at a driven side thereof that is connected to a conveying means for conveying the recording sheet and the inked ribbon inside the ribbon cartridge.

7. An apparatus according to claim 4, wherein the sheet means comprises two guide elements that extend between the opening for transferring the recording sheet into the ribbon cartridge and a sheet placement location against the pressure member and respectively, between the sheet placement location and the opening for transferring the recording sheet out of the ribbon cartridge, extending arcuately upon formation of a respective acceptance space for the inked ribbon.

8. An apparatus according to claim 7, wherein a controllable shunt is arranged in the course of the sheet guide means between the pressure member and the opening for transferring the recording sheet out of the ribbon cartridge and in that a sheet guidance channel branching off from the sheet guide means and returning loop-like to the sheet placement location of the pressure member is arranged following the shunt.

9. An apparatus according to claim 8, wherein the controllable shunt is connectable to the control means in the housing, being connectable thereto via a coupling in the region of the connection of the ribbon cartridge to the housing.

10. An apparatus according to claim 9, wherein the shunt has its control side connected to a stepping feed mechanism incremented in accord with the number of revolutions of the recording sheet in the sheet guidance channel.

11. An apparatus according to claim 10, wherein the stepping feed mechanism is composed of a toothed roller arranged in front of the shunt and having a plurality of teeth corresponding in number to the plurality of prescribed switch positions, of which teeth respectively one tooth in every switch position extends into the conveying path for the recording sheet to such a degree that the stepping feed mechanism is respectively incrementally rotated by the beginning of the recording sheet by respectively one switch position.

* * * * *